US005338585A

United States Patent [19]

Fraus et al.

[11] Patent Number: 5,338,585

[45] Date of Patent: Aug. 16, 1994

[54] ORNAMENTAL CHRISTMAS DISPLAY

[76] Inventors: Joan K. Fraus, 1898 Henrietta, Birmingham, Mich. 48009; Pamela M. S. Smith, 29606 Moran, Farmington Hills, Mich. 48336

[21] Appl. No.: 999,220

[22] Filed: Dec. 31, 1992

[51] Int. Cl.[5] ..... A47G 33/06

[52] U.S. Cl. ..... 428/18; 362/123; 428/100

[58] Field of Search ..... 428/18, 19, 20, 100; 248/27.8, 18; 362/123; 493/956; D11/118

[56] References Cited

U.S. PATENT DOCUMENTS

| | | | |
|---|---|---|---|
| 2,864,192 | 12/1958 | Shoalts | 428/18 X |
| 3,096,943 | 7/1963 | Forrer | 428/19 X |
| 3,677,867 | 7/1972 | Westlund | 428/20 X |
| 3,857,748 | 12/1974 | Thomann | 428/8 |
| 4,543,278 | 9/1985 | Ackerman | 428/18 |
| 4,612,218 | 9/1986 | Enterline | 428/18 X |
| 4,937,107 | 6/1990 | Mirisch, Sr. | 428/18 X |
| 4,968,541 | 11/1990 | McCrory | 428/20 X |

*Primary Examiner*—Henry F. Epstein
*Attorney, Agent, or Firm*—John R. Benefiel

[57] ABSTRACT

An ornamental Christmas display comprising a triangular backing sheet of pliant, easily rolled up material densely covered on one side with garland segments to create a wall hung Christmas tree display. Ornaments, and electric or battery lights further enhance the Christmas tree impression. A central panel of fabric is attached on the lower edge, which is gathered up by contact with a floor or table surface to suggest a draped tree base. The backing sheet has openings into which the garland segments are hooked and which also receive ornament mounting loops.

9 Claims, 2 Drawing Sheets

ORNAMENTAL CHRISTMAS DISPLAY

This invention concerns ornamental displays and more particularly Christmas season displays.

Traditionally, an artificial or natural Christmas tree trimmed with ornaments and strings of small electric lights is used as the primary seasonal display.

Such a display takes considerable space and requires a substantial number of ornaments and lights.

There has heretofore been proposed numerous variations of the traditional Christmas tree display. U.S. Pat. Nos. 4,968,541 and 3,677,867 describe spiral wound garlands hung from a stand or the ceiling to create a display which allows a compact storage after collapse of the garland spiral. However, considerable floor space is required.

U.S. Pat. Nos. 3,857,748, 2,864,192 and 4,612,218 describe wall hung flat panels used to create a Christmas tree display.

This approach still requires substantial storage space for the relatively large panels used.

It is the object of the present invention to provide an ornamental Christmas display occupying little floor space which is able to be compactly configured for storage.

SUMMARY OF THE INVENTION

The present invention comprises a hanging Christmas display which is constructed so as to be able to be rolled up for storage. The display is formed of a pliant backing sheet, preferably formed in a triangular shape to provide a Christmas tree form. The backing sheet is sufficiently compliant to be able to be rolled up for storage, and is formed with a pattern of openings through which short segments of garland, as of artificial evergreen fronds are hooked to create a dense covering of one side of the backing sheet. Ornaments are attached as by means of strap loops also passing through the backing sheet openings, as by VELCRO (TM) patches or strips. One or more strings of electric lights (which may be battery powered) may be also attached to the garland segments.

The backing sheet has a rod or hook attached at its apex to allow hanging from a wall support, with a stiffening rod weighing the lower base edge to insure that the display hangs flat and against the wall.

A panel of fabric of narrower width than the panel base edge is also attached at the center of the lower base edge, which panel is gathered up from a horizontal table or floor surface projecting away from the wall to create the impression of a draped tree base.

DETAILED DESCRIPTION

In the following detailed description, certain specific terminology will be employed for the sake of clarity, but it is to be understood that the same is not intended to be limiting and should not be so construed inasmuch as the invention is capable of taking many forms and variations within the scope of the appended claims.

Figure 1:
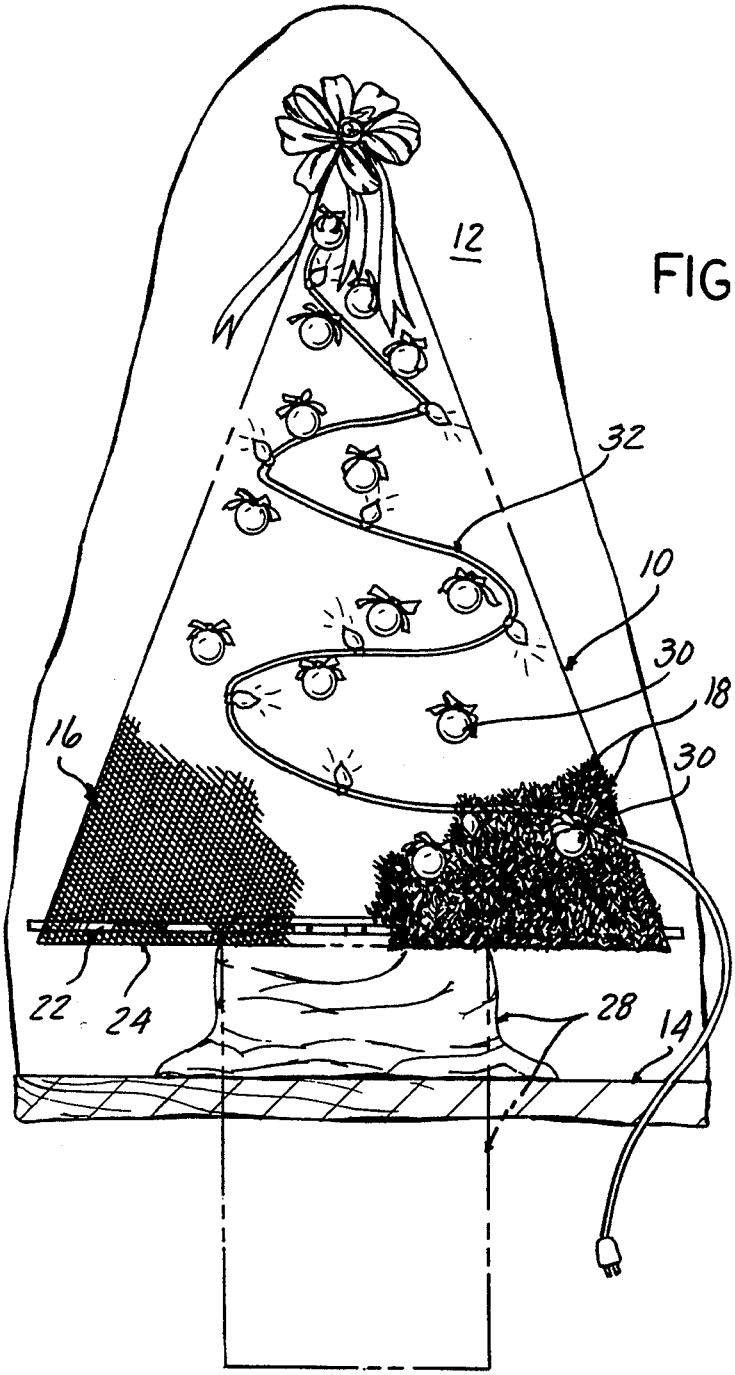
FIG. 1 is a front elevational view of an ornamental display according to the invention with the surface covering partially broken away and shown with fragmentary portions of a supporting wall and adjacent floor or table.
Figure 2:
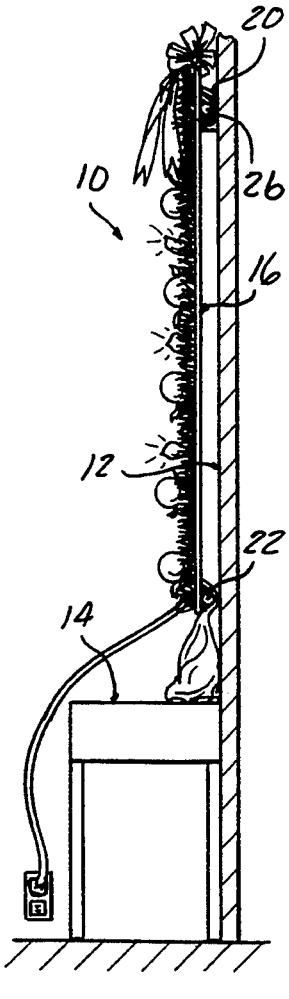
FIG. 2 is a side elevational view of the display shown in FIG. 1, with fragmentary sections of the supporting wall and adjacent table.

Referring to the drawings and particularly FIGS. 1 and 2, an embodiment of the ornamental Christmas display 10 according to the present invention is configured as a substantially two dimensional Christmas tree, adapted to be hung on a vertical wall surface 12, preferably above a horizontal floor or table surface 14.

The display 10 comprises a backing sheet 16 constructed of a pliant material such as a plastic, or plastic mesh or any pliable material, cut, folded, or otherwise shaped into a generally triangular form so as to resemble a Christmas tree outline. The outer face of the pliant sheet 16 is densely covered with short segments of garlands, preferably, artificial evergreen fronds or branches 18, so as to create the impression of an evergreen tree.

When on display, the backing sheet 16 is unrolled and hung from its upper apex, as from a wall mount 20 to be suspended therefrom. A stiffener rod 22 extends across the lower base edge 24 of the backing sheet 16, serving to straighten the base 24 edge of the backing sheet 16, and, to hold the same in an unrolled and stretched condition for display.

Figure 3:
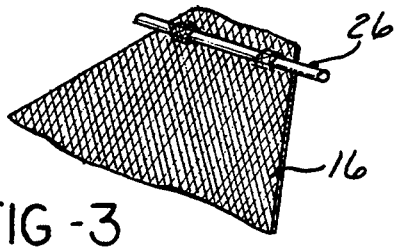
FIG. 3 is an enlarged detail perspective showing the attachment of the support rod.

A short hanging rod 2 may be employed at the apex, as shown in FIG. 3.

Both the stiffener rod 22 and the hanging rod 26 may be conveniently mounted by being interleaved into the openings or attached to the backing sheet 16.

Attached to the lower edge 24 is a centrally located panel 28 of material, preferably of a flaccid material such as fabric, having suitable decorative appeal and coloring, such as a maroon or red velvet. The panel 28 is of narrower width than the base edge 24 and is of extended length, but is gathered upwardly by contact with the floor or table surface 14 to create the impression of draped trunk or base of a Christmas tree as shown in FIG. 1.

Ornaments 30 are also attached to the outer side of the display, as well as one or more strings of electric or battery lights 32, which could be powered by an electrical outlet or by a battery. A ribbon or ornamental top 34 may be used to complete the display 10.

Figure 4:
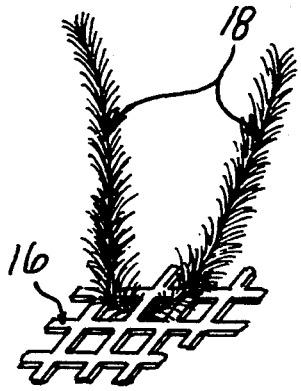
FIG. 4 is an enlarged fragmentary perspective view of a small portion of the backing sheet comprised of a mesh material, and a single garland segment hooked into the openings.

FIG. 4 illustrates the preferred way of attaching garland segments 18 to the backing sheet 16. This method comprises hooking or threading the garland segments 18 through adjacent mesh openings in the backing sheet 16, preferably in a side ways direction parallel to the lower edge as shown to facilitate roll up of the display.

Figure 5:
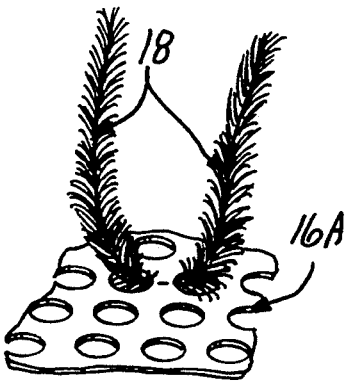
FIG. 5 is an enlarged perspective view of a small portion of an alternately constructed backing plate comprised of a perforated sheet, showing a single garland segment hooked through the backing sheet perforations.

FIG. 5 illustrates an alternate form of the compliant backing sheet 16A, in which a perforated sheet of a suitably compliant material is employed instead of the plastic mesh shown in FIG. 4.

Alternately the garland segments could be used to pierce the backing sheet, or other attachment means such as fasteners, sewing, etc.

Figure 6:
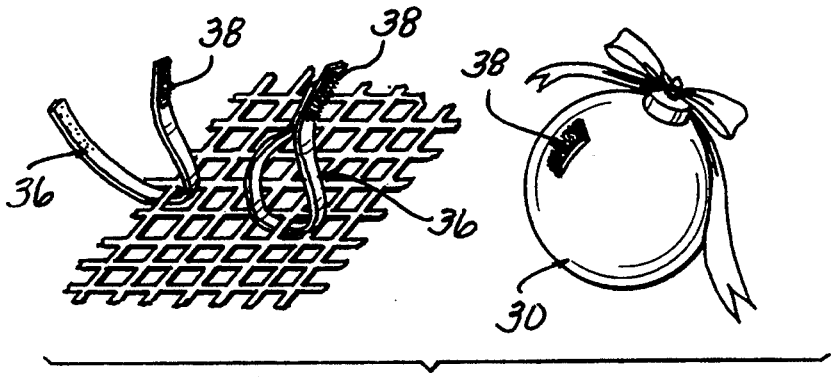
FIG. 6 is an enlarged exploded perspective view of an ornament attaching strap and ornament with an associated section of backing sheet.

The ornaments 30 may advantageously be attached as shown in FIG. 6, by means of short lengths 36 of fabric, or other sheet material having the ends thereof secured with patches of VELCRO (TM) fastener material to form loops. Additional patches 38 of VELCRO (TM) fastener material mate with patches 40 of VELCRO (TM) fastener material on the ornaments 30 to allow easy but secure mounting of the ornaments.

Figure 7:
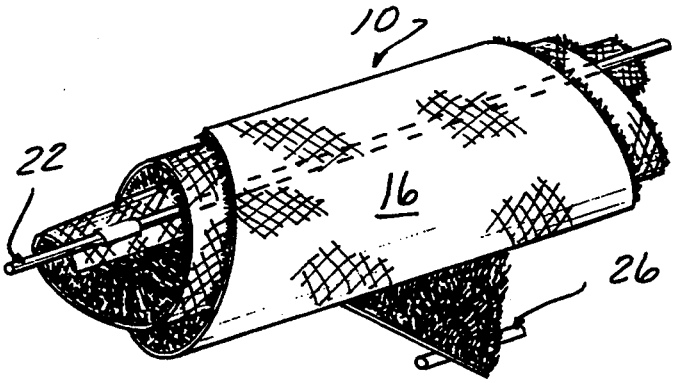
FIG. 7 is a perspective view of the ornamental display of FIGS. 1 and 2 rolled up for storage.

FIG. 7 illustrates how the display 10 is rolled up forming a roll parallel to the base edge having a compact volume for convenient storage of the garland segments and backing sheet.

We claim:

1. An ornamental Christmas tree display comprising:

a backing sheet of a pliable material, in a generally triangular shape having an upper apex and a lower base edge;

said backing sheet formed with a pattern of closely spaced openings;

an array of garland segments interwoven into said openings in said pattern formed in said backing sheet to be attached to said backing sheet, all of said garland segments extending from side-to-side on said backing sheet parallel to said lower base edge;

said array of said garland segments densely covering one side of said backing sheet to create the impression of a Christmas tree; and, a hanging element secured to said apex of said backing sheet to enable vertical hanging of said display, said backing sheet and garland segments being able to be rolled up together without detaching said garland segments by rolling said backing sheet in the direction extending from said lower base edge to said upper apex.

2. The display according to claim 1 further including a panel of fabric material of lesser width than said lower base edge attached to said lower base edge at a central location aligned beneath said apex, to form the impression of a tree base.

3. The display according to claim 1 wherein said garland segments comprise artificial evergreen garlands.

4. The display according to claim 1 wherein said backing sheet comprises a plastic mesh material.

5. The display according to claim 1 further including a stiffener rod attached to the lower base edge of said backing sheet so as to be able to stiffen said lower edge.

6. The display according to claim 1 further including Christmas ornaments attached to said one side of said display.

7. The display according to claim 6 further including a plurality of straps passed through said backing sheet to form loops and VELCRO patches on said straps and ornaments respectively.

8. The display according to claim 6 further including a string of electric or battery lights mounted on said one side of said display.

9. An ornamental Christmas holiday display comprising:

a backing sheet of a pliable material being able to be easily rolled up;

a pattern of closely spaced openings formed into said backing sheet;

artificial evergreen garlands attached on one side of said backing sheet by being interwoven in said openings, all of said garlands extending into the same side-to-side direction parallel to a roll formed when said backing sheet is rolled up with said garlands attached, with said evergreen garlands arranged to completely cover said one side of said backing sheet.

* * * * *